United States Patent [19]

Uemori

[11] Patent Number: 4,671,503

[45] Date of Patent: Jun. 9, 1987

[54] APPARATUS FOR REVERSELY TURNING SIDE OF RECORDING PAPER

[75] Inventor: Satoshi Uemori, Osaka, Japan

[73] Assignee: Mita Industrial Co., Ltd., Osaka, Japan

[21] Appl. No.: 772,746

[22] Filed: Sep. 4, 1985

[30] Foreign Application Priority Data

Oct. 29, 1984 [JP] Japan ..... 59-163439[U]

[51] Int. Cl.[4] ..... B65H 29/00

[52] U.S. Cl. ..... 271/65; 271/186

[58] Field of Search ..... 271/65, 3.1, 66, 184, 271/185, 186, 902

[56] References Cited

U.S. PATENT DOCUMENTS

| | | | |
|---|---|---|---|
| 3,052,468 | 9/1962 | Cutaia et al. | 271/188 |
| 4,220,323 | 9/1980 | Smith | 271/65 |
| 4,299,523 | 11/1981 | Gött et al. | 271/65 X |
| 4,385,825 | 4/1983 | Kaneko | 271/3.1 X |
| 4,386,864 | 6/1983 | Wang et al. | 271/65 X |

FOREIGN PATENT DOCUMENTS

| | | | |
|---|---|---|---|
| 0067456 | 4/1982 | Japan | 271/65 |
| 0292883 | 5/1983 | Netherlands | 271/65 |
| 2122580 | 1/1984 | United Kingdom | 271/65 |

OTHER PUBLICATIONS

Cooper, "Sheet Stacker", IBM Technical Disclosure Bulletin, vol. 14, No. 5 (Oct. 1971) p. 1452.

*Primary Examiner*—Richard A. Schacher

*Attorney, Agent, or Firm*—Wenderoth, Lind & Ponack

[57] ABSTRACT

A recording paper can be discharged on a paper-discharging tray which directs the recording side thereof upward when the tray is in a first position and downward when the tray is in a second position. The tray is movable between the first position, at which the tray is disposed in the vicinity of a paper-discharging device, and the second position, at which the tray is disposed below the paper-discharging device and the tray is inclined with a lower upstream end thereof positioned upstream of an end point of a paper-discharging operation, in the paper-discharging direction.

5 Claims, 9 Drawing Figures

APPARATUS FOR REVERSELY TURNING SIDE OF RECORDING PAPER

BACKGROUND OF THE INVENTION

1. Field of the Invention

The present invention relates to an apparatus for reversely turning the sides of recording paper sheets and which is capable of receiving recording paper sheets discharged from a paper-discharging device of a copying machine, a printer connected to a computer and the like on a paper-discharging tray, with the recording side of each said sheet directed downwardly or upwardly, as chosen.

2. Description of the Prior Art

The arrangement of paper sheets, for example, in copying or printing manuscripts on continued pages, can be omitted by reversely turning the sides of the recording paper sheets, as described above, whereby handling of the sheets is reduced.

However, the reverse turning or inverting of the sides of copying paper sheets has been carried out in such a manner, with reference to FIG. 9, that three conveying rollers 32, 33, 34 are provided at the downstream end of a paper-discharging device 31. A recording paper sheet h being fed in a reverse route E is nipped between engaging first and second conveying rollers 32, 33. The lower end of the recording paper sheet h fed along route E then is fed into a space between engaging second conveying roller 33 and third conveying roller 34 by means of second conveying roller 33, and the recording paper sheet h then is discharged to paper-discharging tray 35 by means of rollers 33, 34.

However, the next recording paper sheet to be reversed cannot be introduced into reverse route E during the switchback of recording paper sheet h by reciprocally moving it in reverse route E, so that a delay time is required, and this is disadvantageous in continuous copying and printing operations.

SUMMARY OF THE INVENTION

The present invention was achieved in view of the above described actual conditions, and it is an object of the present invention to provide an apparatus which is capable of continuously reversely turning or inverting the sides of recording paper sheets without requiring any delay time.

In order to achieve the above described object, an apparatus for reversely turning or inverting the sides of recording paper sheets according to the present invention includes a paper-discharging tray for receiving recording paper sheets discharged from a paper-discharging device. The tray is movable between a first position, at which the tray is disposed in the vicinity of the paper-discharging device, and a second position, at which the tray is disposed below the paper-discharging device and the tray is inclined downwardly in the upstream direction with a lower upstream end of the tray position upstream of a paper-discharging position of the paper-discharging apparatus. The recording paper sheet is received in the tray with the recording side directed upwardly in the first position, and the recording paper is received in the tray with the recording side directed downwardly by rolling or curling the leading end of the recording paper discharged from the end of the paper-discharging position onto and toward the lower upstream end of the tray in the second position.

According to the above described characteristic construction, the sides of recording paper sheets can be reversely turned or inverted in the midst of a series of paperdischarging operations by changing-over the paper-discharging tray to the second position, as chosen or needed.

DESCRIPTION OF THE PREFERRED EMBODIMENTS

Figure 1:
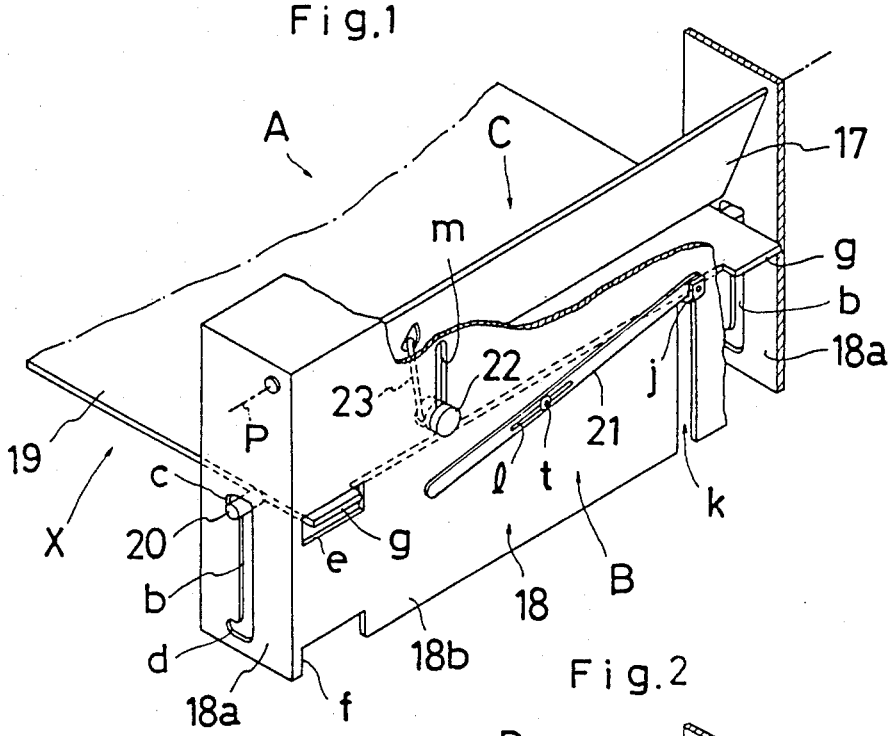
FIG. 1 is a fragmentary perspective view of an apparatus for reversely turning or inverting the sides of recording paper, shown in a first position.
Figure 2:
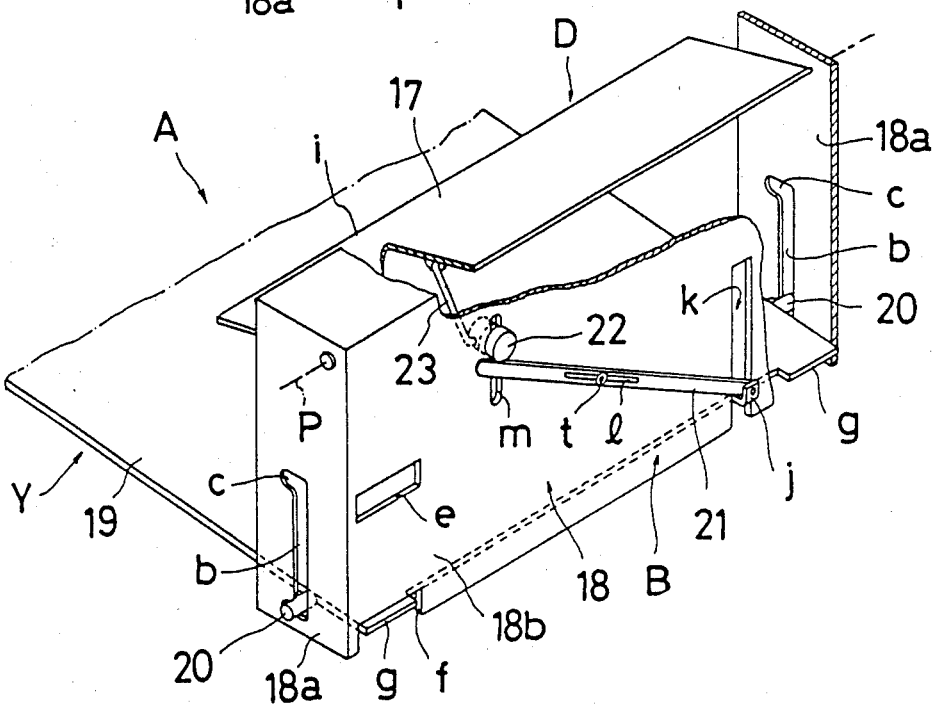
FIG. 2 is a fragmentary perspective view of such apparatus shown in a second position.
Figure 3:
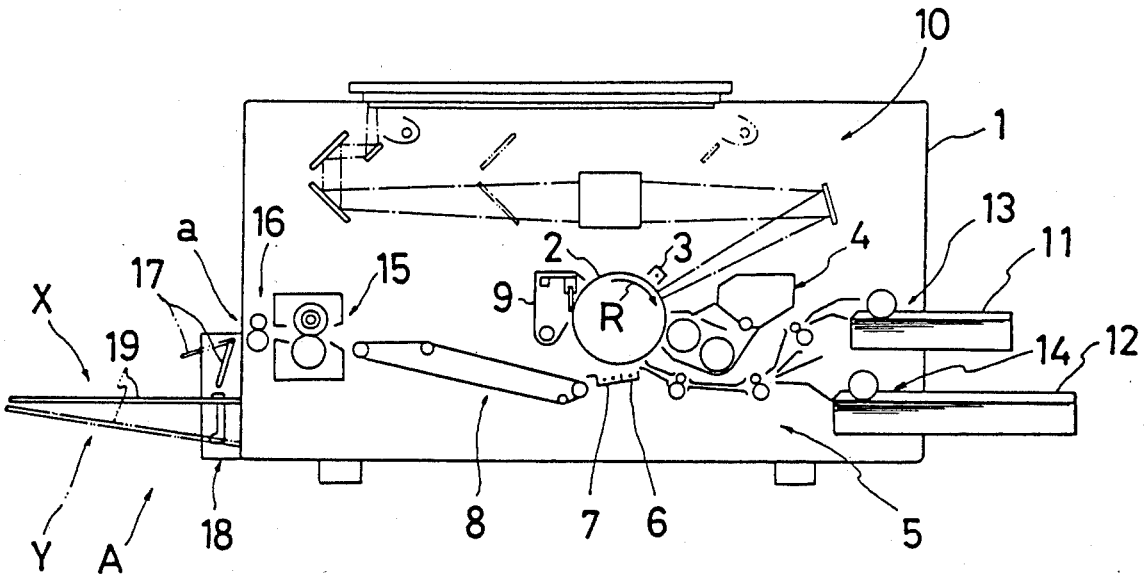
FIG. 3 is a schematic longitudinaly sectioned side view showing a copying machine provided with an apparatus of the invention for reversely turning the sides of recording paper.

The preferred embodiments of the present invention will be blow described with reference to the drawings. Referring now to FIGS. 1, 2 showing an apparatus A for reversely turning or inverting the sides of recording paper or paper sheets and to FIG. 3, which is substantially a longitudinally sectioned view showing a copying machine provided with apparatus A for reversely turning the sides of recording paper, the copying machine is provided with a charging device 3, a developing device 4, a paper-feeding device 5, a transferring device 6, a recording paper-separating device 7, a recording paper-conveying device 8 and a cleaning device 9 arranged around a photoreceptor 2 within a housing 1 in this order along the direction R of rotation of photoreceptor 2. An exposing device 10 of optical system-moving type is provided within the upper space of housing 1. Loading portions 13, 14 of cassette cases 11, 12 are provided upstream of paper-feeding device 5. A fixing device 15 and a paper-discharging device 16, which is composed of a pair of rollers, i.e. an upper roller and a lower roller, are provided downstream of recording paper-conveying device 8. Apparatus A for reversely turning or inverting the sides of the recording paper or paper sheets is connected with paper-discharging device 16.

Apparatus A for reversely turning the sides of the recording paper is constructed a follows.

As shown in FIGS. 1 to 5, a case 18 provided with a paper-discharging guide plate 17, which is freely swingable about a horizontal axis P extending at right angles to the paper-discharging direction, is connected with housing 1 of the copying machine so that horizontal axis P is positioned in the vicinity of the lower edge of a paper-discharging port a. Guide plate-mounting plate members 18*a* of case 18 are provided with elongated hole portions b extending vertically and horizontal hole portions c, d extending downstream in the paper-feeding direction and connected with the upper end and the lower end of respective vertical elongated hole portions b. Cut-outs e and f at levels corresponding to horizontal hole portions c and 3, respectively, are formed in a plate member 18*b* of housing 18 at the side of the copying machine.

Figure 4:
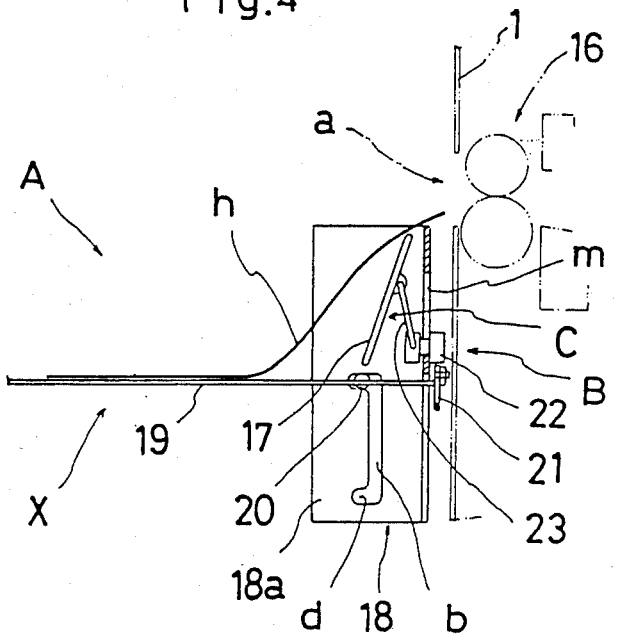
FIGS. 4, 5 are sectional views showing the apparatus of the invention for reversely turning or inverting the sides of recording paper.
Figure 5:
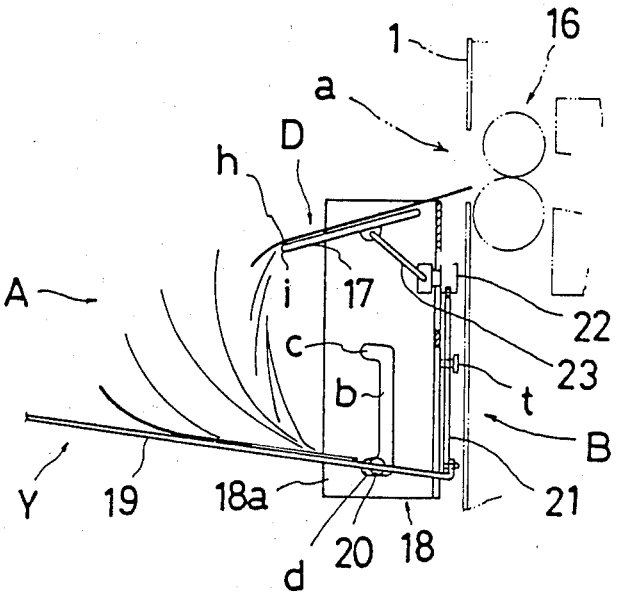

Tongue members g, which are engageable with respective cut-outs e or f, are formed in an edge portion on the upstream side in the paper-feeding direction of a paper-discharging tray 19 receiving recording papers h from paper-discharging device 16. Pins 20, which are movable along respective hold portions b, c, d, are provided on sides of paper-discharging tray 19 so that paper-discharging tray 19 may be moved up and down between a first condition or position, at which tongue members g are engaged with the upper cut-outs e and pins 20 are engaged with the upper horizontal hole portions c, as shown in FIGS. 1, 4 and a second condition or position, at which tongue members g are engaged with the lower cut-outs f and pins 20 are engaged with the lower horizontal hole portions d, as shown in FIGS. 2, 5. The first condition or position is designated as X and the second condition or position is designated as Y.

Paper-discharging tray 19 is connected with paper-discharging guide plate 17 through a connecting mechanism B so that paper-discharging guide plate 17 will be in a non-guiding posture or position C when paper-discharging tray 19 is in first condition X, while paper-discharging guide plate 17 is in a guiding posture or position D when paper-discharging tray 19 is in second condition Y.

Under first condition X in which paper-discharging tray 19 is positioned adjacent paper-discharging device 16, recording papers h discharged from paper-discharging device 16 are discharged onto paper-discharging tray 19 with the recording sides thereof directed upwardly, as shown in FIG. 4.

On the other hand, when paper-discharging tray 19 is changed-over to second condition Y, paper-discharging tray 19 is inclined with the upstream end thereof lower than the downstream end thereof, and with such lower upstream end positioned upstream of an end point i of the discharge of the paper sheet, i.e. the downstream end of paper-discharging guide plate 17. Thus, the leading ends of recording papers h discharged from end point i during a paper-discharging operation are turned or rolled toward the inclined lower upstream end of the upper surface of tray 19, such that recording papers h are positioned on paper-discharging tray 19 with the recording sides thereof directed downwardly under second condition Y, as shown in FIG. 5.

Next, connecting mechanism B will be described. As shown in FIGS. 1, 2, 4 and 5, an upwardly bent plate member j extends from tray 19 in the vicinity of one tongue g thereof. A slit k for allowing up and down movement of bent plate member j is formed in plate member 18*b* of case 18. An arm 21 with an elongated hole 1 formed therein is pivoted on bent plate member j, and arm 21 is connected with plate member 18*b* by a pin t extending through hole 1.

Plate member 18*b* is provided with an elongated hole m extending vertically in the vicinity of the rear or upstream part of paper-discharging guide plate 17. A drum-like or rod-like member 22 is slidably positioned in hole m, and drum-like member 22 is connected with paper-discharging guide plate 17 via a rod 23. Thus, upon movement of paper-discharging tray 19 from first condition X to second condition Y, paper-discharging guide plate 17 will be changed-over from non-guiding position C to guiding position D, and vice versa.

Figure 6:
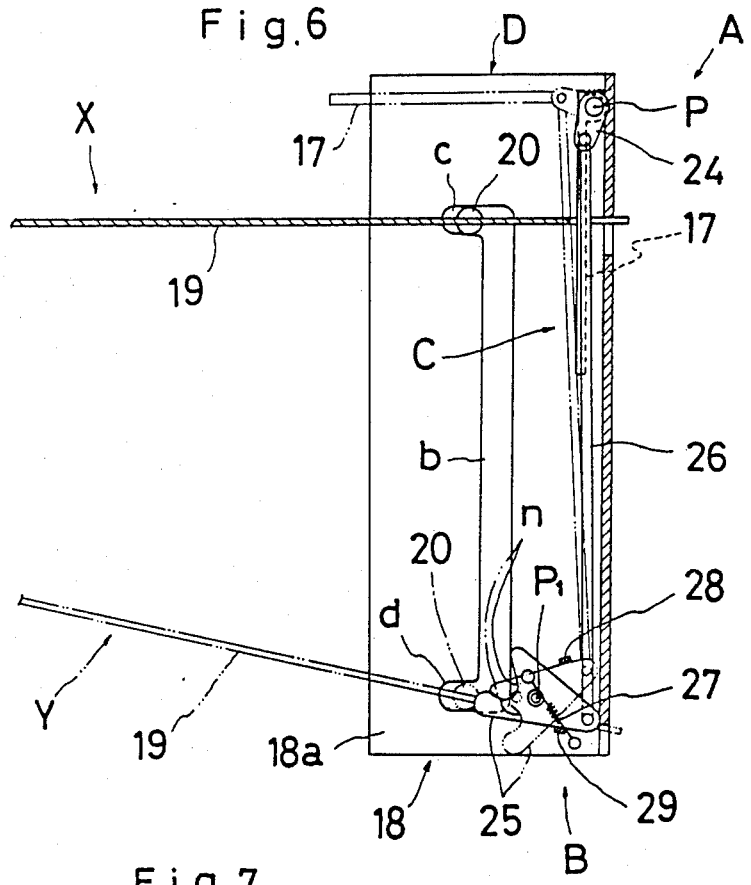
FIGS. 6 to 8 are sectional views showing alternative preferred embodiments of the invention.

Another embodiment of connecting mechanism B is shown in FIG. 6. In this arrangement, an arm 24 is connected with paper-discharging guide plate 17, a fork-like arm 25 is pivoted on the lower portion side of a plate member 18*a*, and both arms 24, 25 are pivotally connected by a rod 26.

A spring 27 is mounted between fork-like arm 25 and plate member 18*a*. Stoppers 28, 29 limit two end pivot positions of arm 25, under the force of spring 27, about a pivot axis $P_1$. A fork-like opening n will face a respective elongated hole portion b under the first condition X, while opening n will face a respective lower horizontal hole portion d under the second condition Y. A respective pin 20 engages fork-like opening n to rotate fork-like arm 25 to a position thereof shown by imaginary lines (in the counterclockwise direction in FIG. 6). As a result, rod 26 is pushed up to change-over paper-discharging guide plate 17 to the guiding posture D when paper-discharging tray 19 is changed-over to the second condition Y, with fork-like arm 25 abutting lower stopper 29.

When paper-discharging tray 19 is changed-over to the first condition X from the above described condition, paper-discharging guide plate 17 is changed-over to the non-guiding posture C in the midst of such changing-over process.

Figure 7:
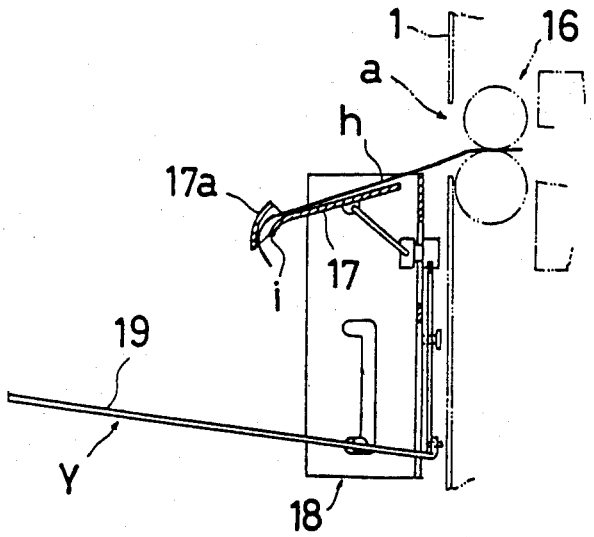

In addition, as shown in FIG. 7, an additional guide plate 17*a* may be provided for forcing the leading end of a recording paper h curl upstream in the paper-discharging direction around end point i of the paper-discharging guide plate 17, thereby to positively reversely turn the sides of recording paper.

Figure 8:
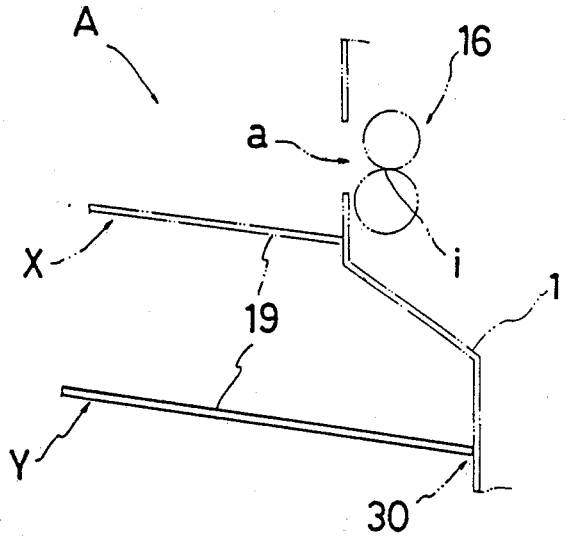
Figure 9:
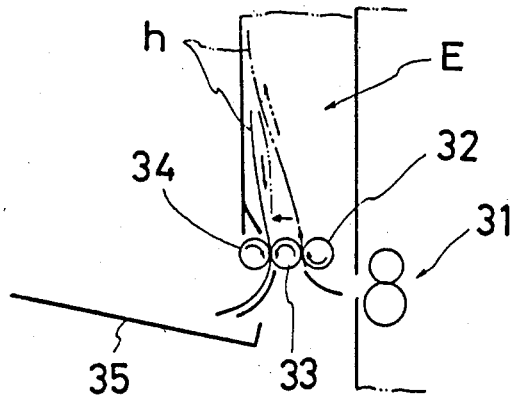
Fig.9 PRIOR ART
FIG. 9 is a sectional view showing a conventional system.

Still another embodiment of an apparatus A for reversely turning the sides of recording paper is shown in FIG. 8. In this case, the second condition Y is achieved by disposing paper-discharging tray 19 in recessed portion 30 formed in the lower portion of paper-discharging device 16. In this construction, the roller-supporting point of paper-discharging device 16 is the end point i of the paper-discharging operation, and the inclined lower upstream end of paper-discharging tray 19 is positioned upstream in the paper-discharging direction of end point i.

As described above, with an apparatus for reversely turning the sides of recording paper sheets according to the present invention not only can a recording paper sheet be discharged with the recording side directed upwardly, but also the recording paper sheet can be discharged with the recording side directed downwardly, by merely changing the vertical position of the paper-discharging tray. In addition, since the recording paper sheet is reversely turned in the midst of a series of paper-discharging operations, continuous copying and printing become possible and the overall construction of the apparatus as a whole is simplified. An apparatus according to the present invention easily can be adapted to existing copying machines, printers and the like. The use of an apparatus according to the present invention leads to high-speed copying and printing.

What is claimed is:

1. An apparatus for reversely turning or inverting the sides of recording paper sheets, said apparatus comprising:

a paper-discharging tray for receiving recording paper sheets discharged from a paper-discharging device in a discharging direction; and means for mounting said tray for movement between a first position, whereat said tray is disposed adjacent the paper-discharging device and at which recording paper sheets are discharged from the paper-discharging device onto said tray with recording sides of the sheets facing upwardly, and a second position, whereat said tray is disposed below the paper-discharging device, said tray is inclined downwardly in an upstream direction with respect to said discharging direction, and said tray has a lower upstream end located upstream of an end portion of discharge of the sheets toward said tray, and at which leading ends of the sheets discharged from said end portion toward said tray curl around said end portion toward said lower upstream end of said tray, whereby the sheets are discharged onto the tray with recording sides of the sheets facing upwardly.

2. An apparatus as claimed in claim 1, further comprising a paper-discharging guiding plate mounted at a position adjacent the paper-discharging device, and means connecting said tray with said guiding plate such that when said tray is in said first position thereof said guiding plate is in a non-guiding position, whereat the sheets discharged from the paper-discharging device pass directly to said tray, and such that when said tray is in said second position thereof said guiding plate is in a guiding position, whereat the sheets discharged from the paper-discharging device pass over said guiding plate and then to said tray.

3. An apparatus as claimed in claim 2, wherein when said tray is in said second position and said guiding plate is in said guiding position, said guiding plate has a downstream end defining said end portion.

4. An apparatus as claimed in claim 3, further comprising an additional guide plate mounted adjacent said downstream end of said guiding plate and defining means for positively curling the leading ends of the sheets about said downstream end.

5. An apparatus as claimed in claim 2, wherein said guiding plate is pivotally mounted about an axis extending transverse to said discharging direction.

* * * * *